US007150691B2

(12) United States Patent
Gait et al.

(10) Patent No.: US 7,150,691 B2
(45) **Date of Patent: *Dec. 19, 2006**

(54) LACROSSE HEAD WITH EDGE PROTRUSIONS

(75) Inventors: Gary C. Gait, Lutherville, MD (US); Dale W. Kohler, Hunt Valley, MD (US)

(73) Assignee: STX, LLC, Baltimore, MD (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/139,498

(22) Filed: May 31, 2005

(65) Prior Publication Data

US 2005/0221923 A1 Oct. 6, 2005

Related U.S. Application Data

(63) Continuation of application No. 10/609,480, filed on Jul. 1, 2003, now Pat. No. 6,923,739.

(60) Provisional application No. 60/392,932, filed on Jul. 2, 2002.

(51) Int. Cl.
*A63B 59/02* (2006.01)
*A63B 65/12* (2006.01)

(52) U.S. Cl. ..... 473/513; D21/724

(58) Field of Classification Search ..... 473/513, 473/512, 505; D21/724
See application file for complete search history.

(56) References Cited

U.S. PATENT DOCUMENTS 3,507,495 A 4/1970 Tucker et al.
3,592,466 A * 7/1971 Parsons ..... 482/53
3,596,300 A * 8/1971 D'Amico ..... 7/106
4,034,984 A 7/1977 Crawford et al.
5,080,372 A 1/1992 Brine, III et al.
5,566,947 A 10/1996 Tucker et al.
5,651,549 A 7/1997 Dill et al.
5,935,026 A 8/1999 Dill et al.
6,066,056 A * 5/2000 Morrow ..... 473/513
6,561,932 B1 5/2003 Morrow et al.
6,723,134 B1 4/2004 Tucker, Sr.
6,923,739 B1 * 8/2005 Gait et al. ..... 473/513

* cited by examiner

*Primary Examiner*—Eugene Kim
*Assistant Examiner*—M. Chambers
(74) *Attorney, Agent, or Firm*—Steven P. Arnheim; Paul, Hastings, Janofsky & Walker

(57) ABSTRACT

A lacrosse head having protrusions on its top and/or bottom edges, which improve ball control. Preferably, the protrusions on the top edge protrude toward the interior of the lacrosse head and the protrusions on the bottom edge protrude away from the interior of the lacrosse head. In a further embodiment, the lacrosse head has a top protrusion disposed on the top edge of a sidewall, and a bottom protrusion on disposed on the bottom edge of the sidewall, such that any height of the lacrosse head frame, inclusive of the top protrusion and the bottom protrusion, does not exceed a specified sidewall height, even though the sum of the height of the sidewall, the height of the top protrusion, and the height of the bottom protrusion, measured separately and nonlinearly, exceed the specified sidewall height.

24 Claims, 8 Drawing Sheets

LACROSSE HEAD WITH EDGE PROTRUSIONS

This application is a continuation application of U.S. patent application Ser. No. 10/609,480, filed Jul. 1, 2003, which claims the benefit of U.S. Provisional Application No. 60/392,932, filed Jul. 2, 2002, both of which are herein incorporated by reference in their entirety.

BACKGROUND

1. Field of the Invention

The present invention relates generally to lacrosse sticks, and more particularly, to a lacrosse head having protrusions on its top and/or bottom edges, which improve ball control.

2. Background of the Invention

FIG. 1 illustrates a conventional lacrosse stick 100 having a handle 102 shown in dotted lines, and a double-wall synthetic head 104. Head 104 comprises a generally V-shaped frame having a juncture 106, sidewalls 108 and 110, a transverse wall (or "scoop") 112 joining the sidewalls at their ends opposite juncture 106, and a stop member 114 joining sidewalls 108 and 110 at their ends nearest juncture 106. As used herein, the area enclosed by the frame of head 104 (i.e., sidewalls 108 and 110, transverse wall 112, and stop member 114) is referred to as the interior of head 104.

As shown in FIG. 1, handle 102 fits into and through juncture 106, and abuts stop member 114. A screw or other fastener placed through opening 107 secures handle 102 to head 104.

For traditionally-strung pockets (which have thongs and string instead of mesh), thongs (not shown) made of leather or synthetic material extend from upper thong holes 116 in transverse wall 112 to lower thong holes 118 in stop member 114. In some designs, such as the design shown in FIG. 1, upper thong holes 116 are located on tabs 117 of the scoop 112. On other designs, upper thong holes 116 are located directly on the scoop 112. FIG. 1 shows four pairs (116, 118) of thong holes that accept four thongs. To complete the pocket web, the thongs have nylon strings threaded around the thongs and string laced through string holes 120 in sidewalls 108 and 110, forming any number of diamonds (crosslacing). Finally, one or more throwing or shooting strings extend transversely between the upper portions of sidewalls 108 and 110, attaching to throwing string holes 124 and a string laced through string holes 122. The typical features of a lacrosse stick are shown generally in Tucker et al., U.S. Pat. No. 3,507,495, Crawford et al., U.S. Pat. No. 4,034,984, and Tucker et al., U.S. Pat. No. 5,566,947, which are all incorporated by reference herein.

Of particular relevance to the present invention are rules relating to the height of the sidewalls of the head. In a lacrosse game, these dimensional requirements prevent a player from using a stick that unfairly protects the lacrosse ball within a deeper pocket, such that it is more difficult for opponents to check the ball free. For this reason, men's rules permit a pocket depth of up to 2½ inches, below a sidewall that is up to 2 inches high. According to the traditional test, when looking horizontally at the sidewall of the men's lacrosse stick with a regulation ball inside the pocket, the sidewall must obstruct the view of at least a portion of the ball. (The total height of the sidewall and pocket must not exceed 4½ inches.) Similarly, women's rules limit the height of the sidewall to 1.8 inches (1⅘ inches or 4.5 cm) at the point of its greatest height, such that the top of a regulation ball placed inside the pocket can be always be seen over the sidewall when looking horizontally at the sidewall.

Referring again to FIG. 1, sidewalls 108 and 110 have an inside face, an outside face generally opposite the inside face, a bottom edge, and a top edge generally opposite the bottom edge. The inside face generally faces the interior of the head 104 (i.e., toward the pocket). The bottom edge is on the side of the head 104 on which the pocket is disposed. Similarly, stop member 114 has an inside face, a bottom edge, and a top edge generally opposite the bottom edge. The inside face of stop member 114 generally faces the interior of the head 104 (i.e., toward the pocket). The bottom edge of stop member 114 is on the side of the head 104 on which the pocket is disposed.

Traditionally, the inside face of a conventional sidewall or stop member is substantially perpendicular to the plane of the front face of head 104. This geometry allows a ball to freely roll over a sidewall or stop member without obstruction, from the back of the pocket to the front face of head 104. Players would prefer, however, means to limit the free travel of the ball over the sidewall and stop member, to better retain the ball within the pocket and maximize ball control.

U.S. Pat. No. 6,066,056 to Morrow attempts to meet these needs with a lacrosse head having ball retaining ridges that extend along the interior surface of the sidewalls and serve to direct and retain the ball within the pocket. Unfortunately, the placement of these ridges on the interior surface of the sidewalls limits the ball control advantages it provides for the entire height of the sidewall, especially with respect to pocket swing and the geometry by which the ball is rebounded into the pocket. In addition, the placement of the ridges on the interior surface of the sidewalls adds undesirable weight to the head. Finally, Morrow does not provide any specific ball control improvements relative to the stop member.

Thus, there remains a need for a lacrosse head that improves ball control over the stop member and the entire height of the sidewall. Furthermore, there is a need for a lacrosse head that provides these improvements without adding substantial weight and with an eye toward compliance with rules limiting sidewall height.

SUMMARY OF THE INVENTION

The present invention is a lacrosse head having a plurality of protrusions extending from one or both of its top and bottom edges. Protrusions on the top edge of the head are referred to herein as teeth, and are preferably located on the top edge of one or both sidewalls of the head. Protrusions on the bottom edge of the head are referred to herein as tabs, and are preferably located on the bottom edge of one or both sidewalls of the head and/or the bottom edge of the stop member of the head.

In an embodiment of the present invention, teeth protrude from the top edge of a sidewall in a direction toward the interior area of the lacrosse head frame. In this manner, when a ball inside the pocket contacts the top edge of the sidewall, the protruding structure of the teeth tends to rebound the ball back inside the lacrosse head frame. In contrast to a conventional sidewall, which allows a ball to freely travel over the sidewall, the teeth provide a rebound into the pocket that is especially helpful when a ball rattles in the pocket, for example, as a result of a stick check. As the ball rattles between the sidewalls, the protruding teeth help keep the ball within the pocket. In addition, having the teeth on the sidewall edge provides a favorable geometry in rebounding the ball from the front face of the head back toward the interior area of the lacrosse head. Thus, the teeth afford greater control of the ball, by directing the movement of the ball toward the pocket.

In another embodiment, the present invention provides tabs on the bottom edge of a sidewall and/or stop member. The tabs protrude in a direction away from the interior area of the lacrosse head frame. In this manner, when a ball inside the pocket contacts the bottom edge of the sidewall and/or stop member, the protruding structure of the tabs tends to catch and hold the ball within the pocket. Further enhancing this effect, as the pocket swings away from the center of the lacrosse head, the ball moves farther under the tabs, which effectively wedges the ball in the pocket. During cradling, this wedge effect occurs each time the ball swings from sidewall to sidewall, making it difficult to dislodge the ball from the pocket. Thus, the tabs afford better protection of the ball, by providing a surface against which to hold the ball in the pocket. Optionally, the tabs can include threading holes through which pocket threading can be strung.

Another embodiment of the present invention provides a lacrosse head frame having alternating top edge and bottom edge sidewall protrusions that ensure that the lacrosse head frame complies with rules limiting the overall height of the sidewall. In other words, when looking at the outside face of a sidewall with the lacrosse head in a horizontal position, the protrusions are disposed along the top and bottom edges of the sidewall such that the measured height of the lacrosse head, inclusive of the protrusions, does not exceed a maximum specified height (e.g., 2 inches under the men's rules). Typically, this height would be measured along a line substantially perpendicular to the top edge of the sidewall or to the axis of the shaft attached to the lacrosse head frame. Notably, by alternating the top and bottom protrusions, the sum of the height of the top protrusion, the height of the bottom protrusion, and the height of the sidewall, measured separately and nonlinearly, can exceed the specified maximum specified height—yet, the overall sidewall height, as typically measured for compliance, does not exceed the specified maximum height. In a specific implementation of the present invention, four teeth on the top edge of a sidewall alternate with five tabs on the bottom edge of the sidewall.

DETAILED DESCRIPTION OF THE INVENTION

Figure 1:
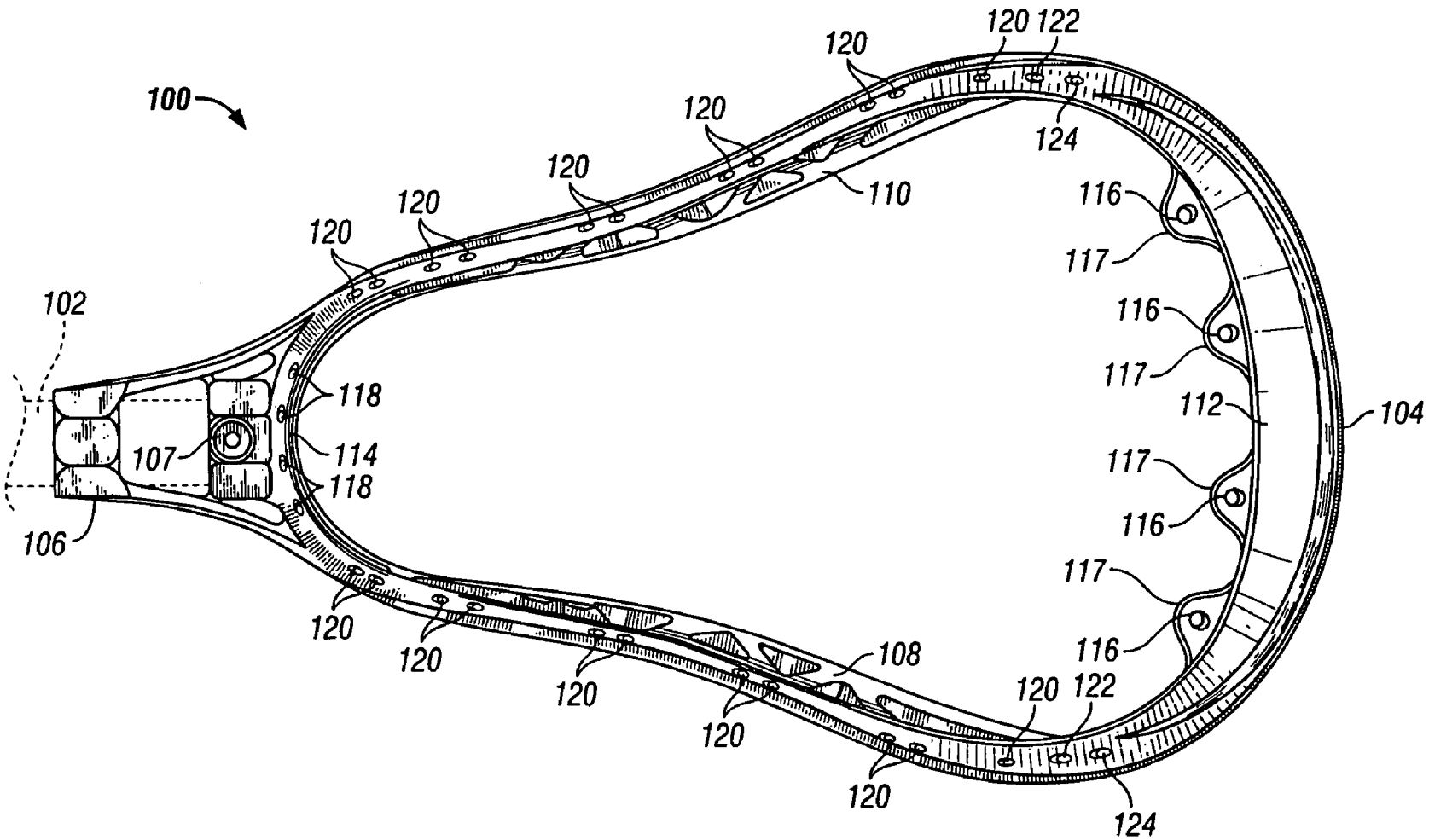
FIG. 1 (Prior Art)
FIG. 1 is a schematic diagram of a lacrosse stick.
Figure 2A:
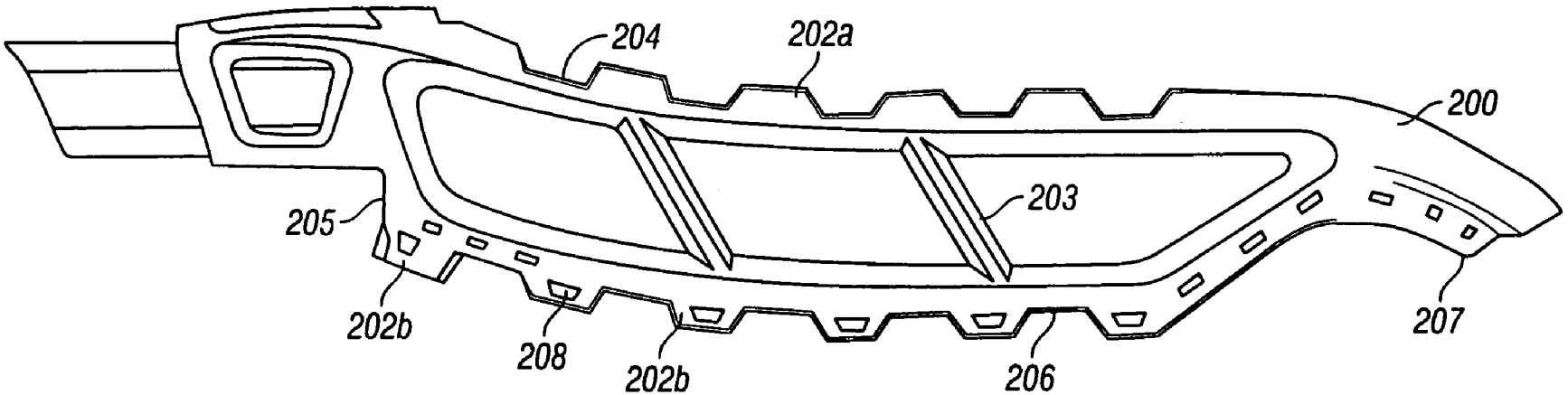
FIG. 2A is a schematic diagram of a side view of an exemplary lacrosse head, shown with surface shading, according to an embodiment of the present invention.
Figure 2B:
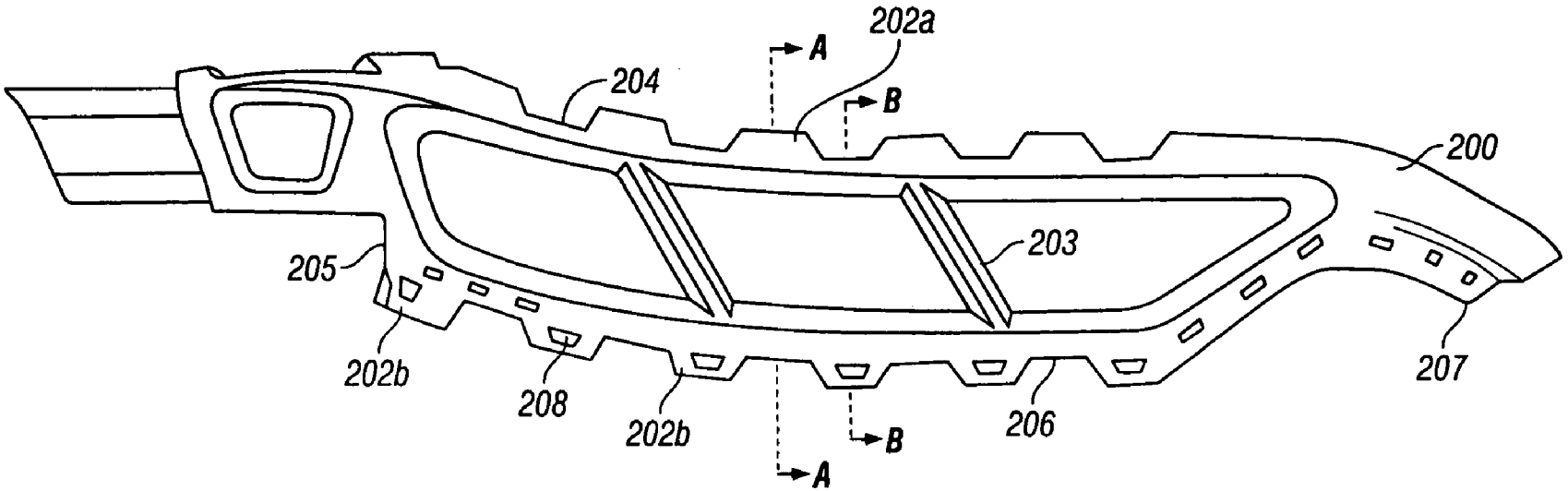
FIG. 2B is a schematic diagram of the lacrosse stick of FIG. 2A, without shading, and showing cross-section lines A and B.

According to an embodiment, FIGS. 2A and 2B illustrate an exemplary lacrosse head 200 having protrusions 202 on the edges of its sidewall 203 and stop member 205. The protrusions 202*a* on the top edge 204 of sidewall 203 are referred to herein as teeth. The protrusions 202*b* on the bottom edge 206 of sidewall 203 and the bottom edge of stop member 205 are referred to herein as tabs. Optionally, as shown in this example, the tabs 202*b* have openings 208 to which pocket threads (not shown) can be attached.

Figure 2C:
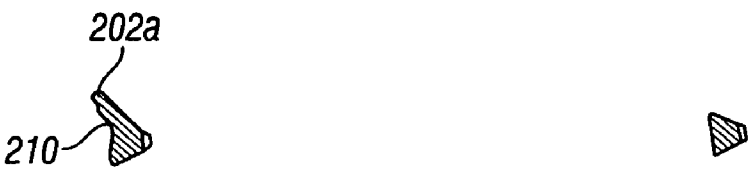
FIG. 2C is a schematic diagram of a cross-sectional view of the lacrosse head of FIG. 2B along line A.

FIG. 2C illustrates a tooth 202*a* in more detail. As shown, tooth 202*a* protrudes toward the interior of lacrosse head 200. In this configuration, the inside face 210 of tooth 202*a* rebounds the ball back toward the pocket of head 200, enhancing a player's ability to keep a ball in the pocket. Although a particular shape, angle, and length of tooth 202*a* is shown in FIGS. 2A, 2B, and 2C, one of ordinary skill in the art would appreciate that these characteristics could vary to satisfy different performance characteristics.

Figure 2D:
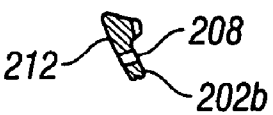
FIG. 2D is a schematic diagram of a cross-sectional view of the lacrosse head of FIG. 2B along line B.

FIG. 2D illustrates a tab 202*b* in more detail, including the thread opening 208 of the tab 202*b*. As shown, tab 202*b* protrudes away from the interior of lacrosse head 200. In this configuration, the inside face 212 of tab 202*b* holds a ball inside the pocket of head 200. Although a particular shape, angle, and length of tab 202*b* is shown in FIGS. 2A, 2B, and 2D, one of ordinary skill in the art would appreciate that these characteristics could vary to satisfy different performance characteristics. In addition, although FIGS. 2A, 2B, and 2D show tabs 202*b* only on sidewall 203 and stop member 205, similar tabs 202*b* could be disposed on scoop 207.

FIGS. 2A and 2B also demonstrate a series of teeth that alternates with a series of tabs. The series of teeth include spaces between adjacent teeth. Likewise, the series of tabs include spaces between adjacent tabs. The teeth 202*a* and tabs 202*b* alternate such that any measurement of the sidewall height, inclusive of the teeth 202*a* and tabs 202*b*, does not exceed a specified maximum sidewall height (e.g., 2 inches in the men's game). In this exemplary alternating arrangement, generally, no tab 202*b* on the bottom edge 206 of sidewall 203 is positioned below a tooth 202*a* on the top edge 204. In other words, referring to FIG. 2B, no two protrusions 202 are generally located along a vertical line drawn approximately perpendicular to the top edge 204 and/or bottom edge 206 (or the axis of the shaft), such as lines A and B. In this way, the maximum height that could be included in measuring the height of sidewall 203 would include only one protrusion 202, and not two protrusions 202. This alternating configuration enables the present invention to provide the performance benefits associated with teeth 202*a* and tabs 202*b*, while still complying with any applicable rules limiting the height of a sidewall (e.g., the current women's rule limiting the sidewall height to 1.8 inches and the current men's rule limiting the sidewall height to 2 inches).

As one of ordinary skill in the art would appreciate, and as shown in FIG. 2B, the alternating teeth 202*a* and tabs 202*b* can overlap to a certain extent and still comply with the maximum specified sidewall height. For example, a tab and a tooth can overlap in an area in which one is decreasing in height and the other is increasing in height at approximately the same rates. In this way, their combined height remains roughly the same. In FIG. 2B, in the area between lines A and B, the overlapping tapered corners of tabs 202*a* and teeth 202*b* exemplify this configuration.

Figure 3A:
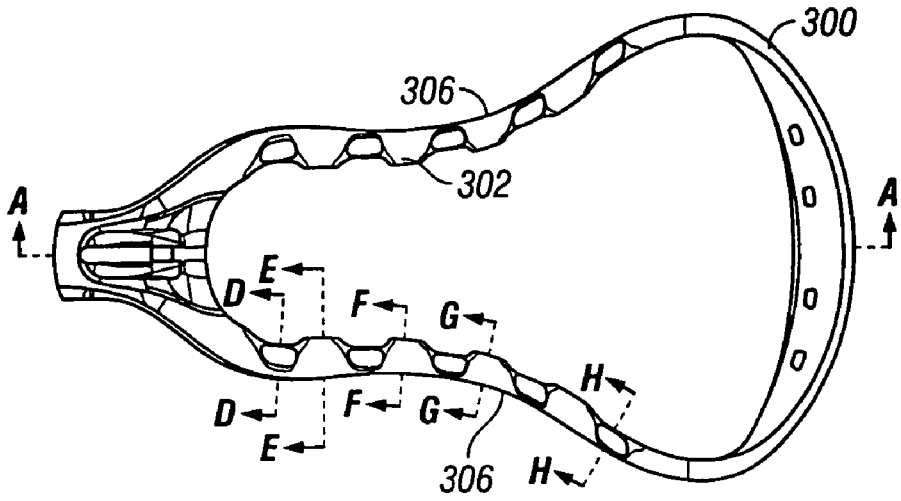
FIG. 3A is a schematic diagram of a top view of an exemplary lacrosse head, according to an embodiment of the present invention.
Figure 3B:
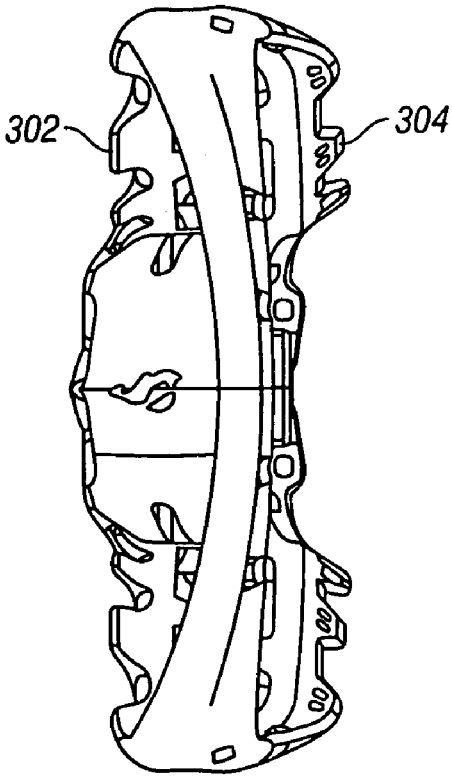
FIG. 3B is a schematic diagram of a side view of the lacrosse head of FIG. 3A, facing the scoop of the lacrosse head.
Figure 3C:
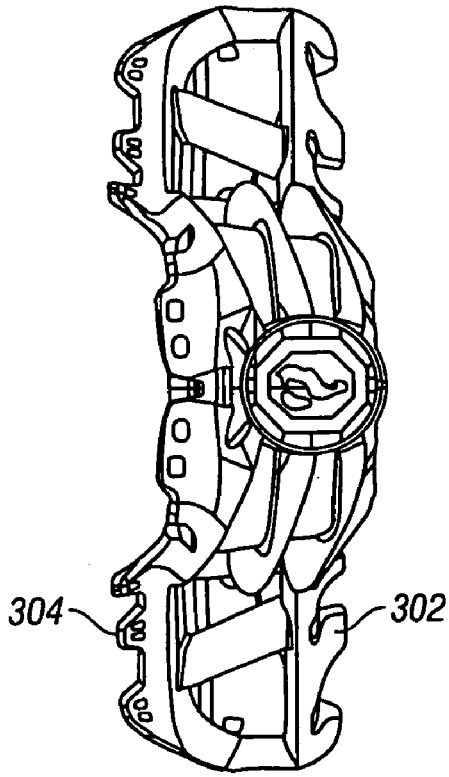
FIG. 3C is a schematic diagram of a side view of the lacrosse head of FIG. 3A, facing the juncture of the lacrosse head.
Figure 3D:
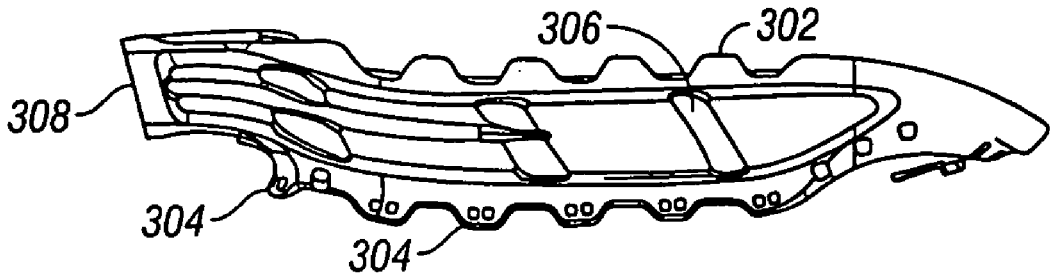
FIG. 3D is a schematic diagram of a side view of the lacrosse head of FIG. 3A, facing the outside face of a sidewall of the lacrosse head.
Figure 3E:
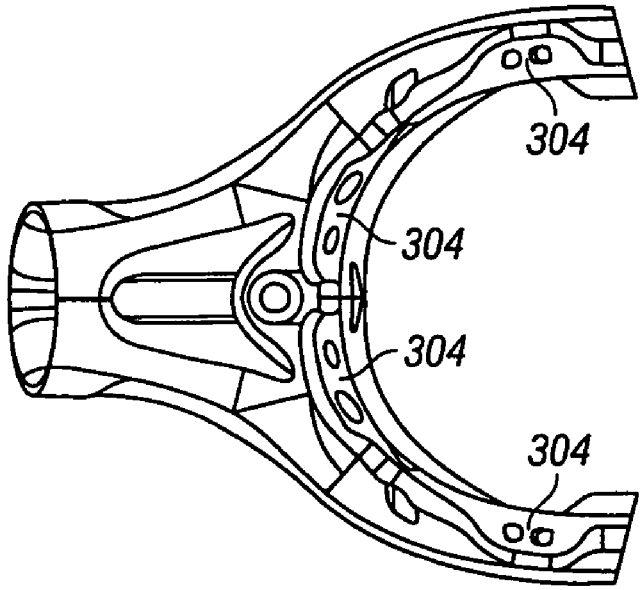
FIG. 3E is a schematic diagram of a partial bottom view of the lacrosse head of FIG. 3A.

FIGS. 3A—3E illustrate another exemplary lacrosse head 300 having teeth 302 and tabs 304, according to an embodiment of the present invention. As shown best in FIGS. 3B and 3C, teeth 302 protrude inward toward the interior of lacrosse head 300, while tabs 304 flare outward away from the interior of lacrosse head 300. FIG. 3D shows the alternating placement of each of the teeth 302 and tabs 304, such that any measurement of the sidewall height, inclusive of the teeth 302 and tabs 304, does not exceed a specified maximum sidewall height, even though the sum of the height of the sidewall 306, the height of a tooth 302, and the height of the tab 304, measured separately and nonlinearly, exceed the specified maximum sidewall height. As shown in the alternating configuration, generally no tooth 302 is disposed over a tab 304. The sidewall height would be measured on a line drawn across the height of sidewall 306 roughly perpendicular to the axis of the juncture 308 that receives the lacrosse stick shaft.

Figure 4:
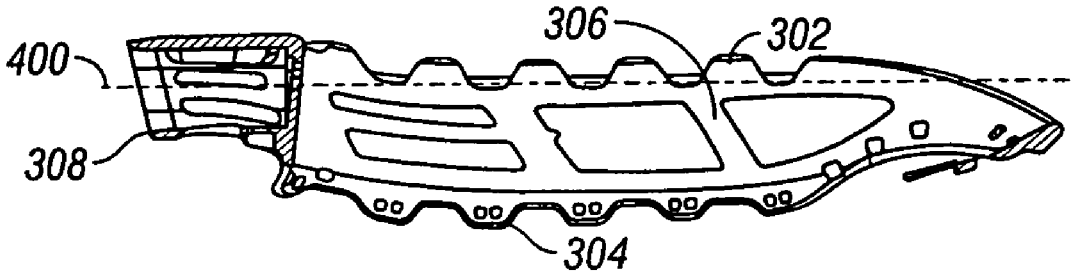
FIG. 4 is a schematic diagram of a cross-section of the lacrosse head of FIG. 3A along line A—A.

FIG. 4 illustrates a cross-sectional view of the lacrosse head 300 of FIG. 3A along line A—A. This cross-sectional view shows the axis 400 of juncture 308 and the inside face of a sidewall 306 of lacrosse head 300, including inside views of teeth 302 and tabs 304.

Figure 5:
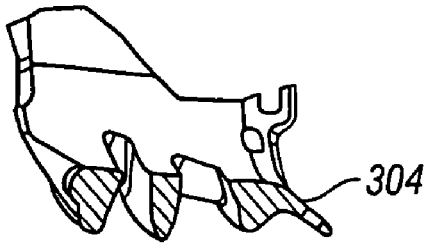
FIG. 5 is a schematic diagram of a cross-section of the lacrosse head of FIG. 3A along line D—D.

FIG. 5 illustrates a cross-sectional view of the lacrosse head 300 of FIG. 3A along line D—D. This view shows an example of how a tab 304 can flare away from the interior of head 300.

Figure 6:
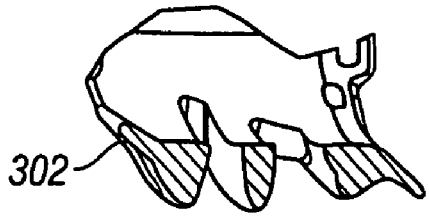
FIG. 6 is a schematic diagram of a cross-section of the lacrosse head of FIG. 3A along line E—E.

FIG. 6 illustrates a cross-sectional view of the lacrosse head 300 of FIG. 3A along line E—E. This view shows an example of how a tooth 302 can protrude toward the interior of head 300.

Figure 7:
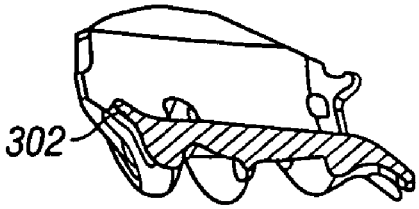
FIG. 7 is a schematic diagram of a cross-section of the lacrosse head of FIG. 3A along line F—F.

FIG. 7 illustrates a cross-sectional view of the lacrosse head 300 of FIG. 3A along line F—F. This view shows another example of how a tooth 302 can protrude toward the interior of head 300.

Figure 8:
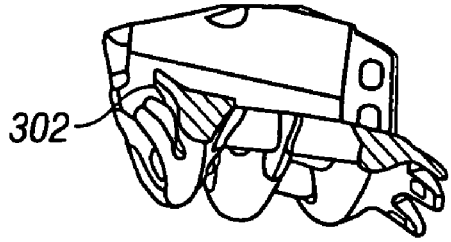
FIG. 8 is a schematic diagram of a cross-section of the lacrosse head of FIG. 3A along line G—G.

FIG. 8 illustrates a cross-sectional view of the lacrosse head 300 of FIG. 3A along line F—F. This view shows another example of how a tooth 302 can protrude toward the interior of head 300.

Figure 9:
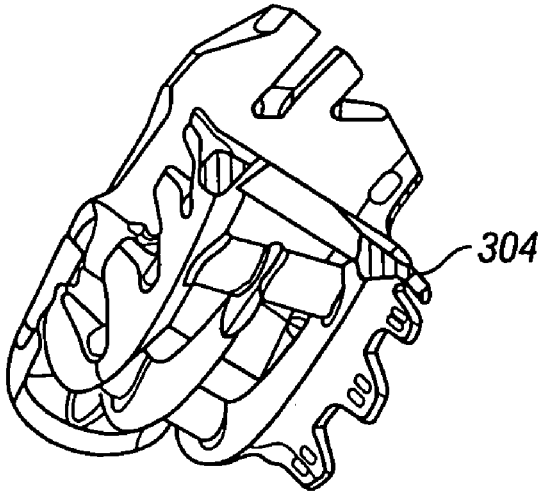
FIG. 9 is a schematic diagram of a cross-section of the lacrosse head of FIG. 3A along line H—H.

FIG. 9 illustrates a cross-sectional view of the lacrosse head 300 of FIG. 3A along line H—H. This view shows another example of how a tab 304 can flare away from the interior of head 300.

Figure 10:
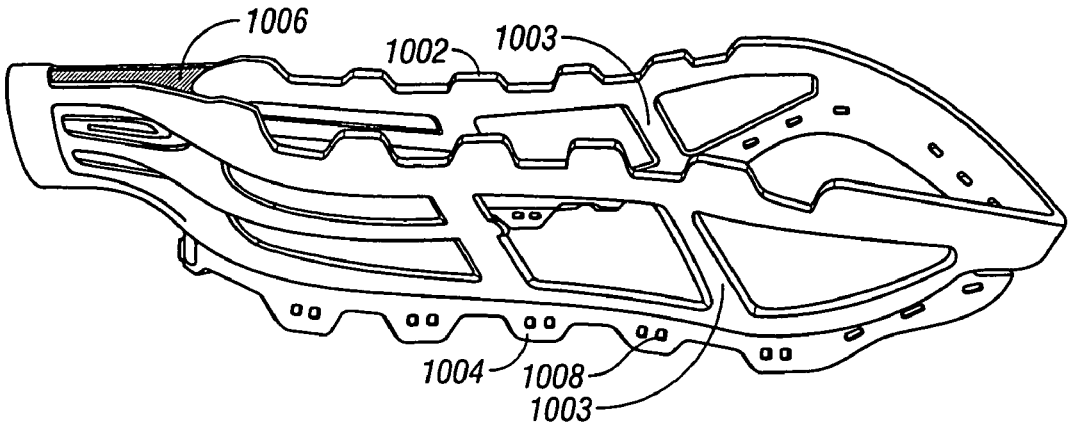
FIG. 10 is an image of an isometric view of an exemplary lacrosse head, facing the outside face of a sidewall of the lacrosse head, according to an embodiment of the present invention.
Figure 11:
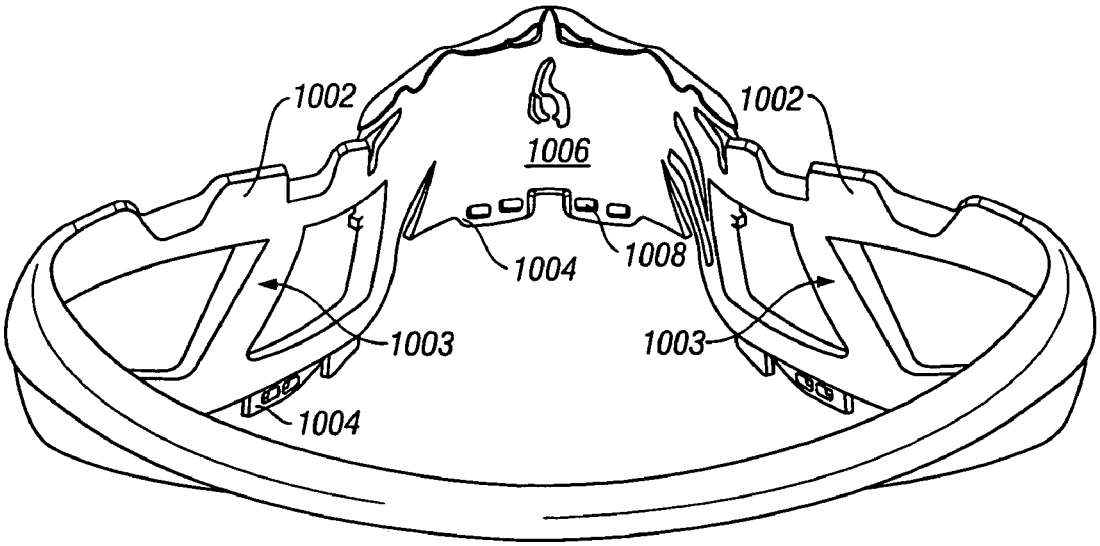
FIG. 11 is an image of an isometric view of an exemplary lacrosse head, facing the scoop of the lacrosse head and looking down on the top edge of the sidewalls, according to an embodiment of the present invention.
Figure 12:
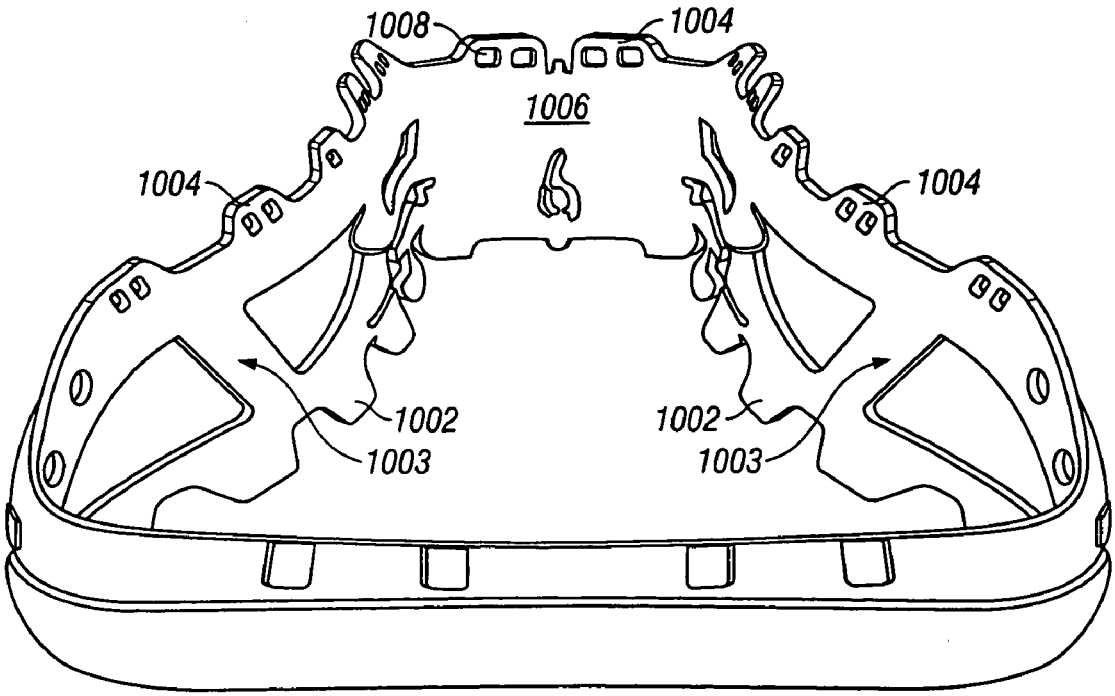
FIG. 12 is an image of an isometric view of an exemplary lacrosse head, facing the scoop of the lacrosse head and looking down on the bottom edge of the sidewalls, according to an embodiment of the present invention.

FIGS. 10, 11, and 12 illustrate an exemplary implementation of the present invention. As shown, this implementation includes teeth 1002 that curve toward the interior of the lacrosse head 1000 and tabs 1004 that flare out away from the interior of the lacrosse head 1000. The teeth 1002 are disposed on the top edge of the sidewalls 1003. The tabs 1004 are located on the bottom edge of the sidewalls 1003 and the stop member 1006. The tabs 1004 include openings 1008 through which pocket threads can be strung.

Figure 13:
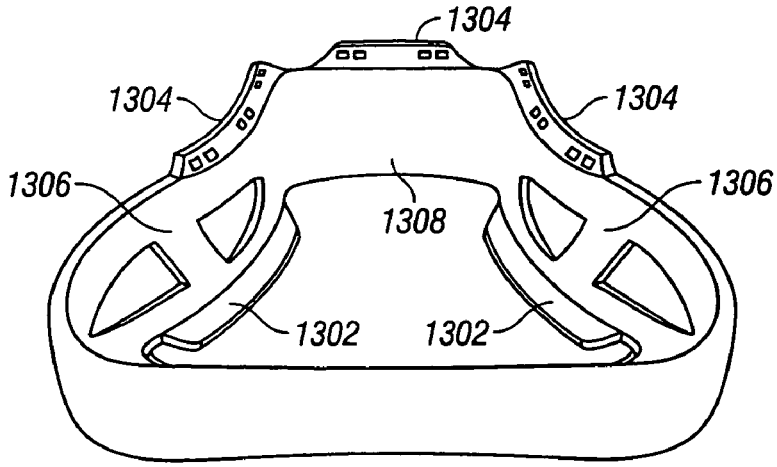
FIG. 13 is a schematic diagram of isometric view of an exemplary lacrosse head having continuous sidewall edge protrusions facing the scoop and looking down on the bottom edge of the sidewalls.

As an alternative to the embodiments above, which illustrate a plurality of individual protrusions that are spaced apart on the edge of a sidewall, another embodiment provides a single continuous protrusion along an edge of a sidewall, examples of which are shown in FIG. 13. FIG. 13 illustrates a lacrosse head positioned face down, looking down on the bottom edge of the sidewalls. In this example, one continuous tooth 1302 is disposed on the top edge of a sidewall 1306. Similarly, one continuous tab 1304 is disposed on the bottom edge of a sidewall 1306 or stop member 1308. Like a series of individual protrusions along an edge of a sidewall, a single continuous protrusion would also protrude toward the interior of the head (in the case of a protrusion on the top edge of a sidewall) or away from the interior of the head (in the case of a protrusion on the bottom edge of a sidewall). A single continuous protrusion could, of course, also be disposed on edges of the scoop, as appropriate.

In contrast to a continuous protrusion, however, having one or more individual protrusions along the edge of a sidewall reduces the overall weight of the lacrosse head, while still providing the above-mentioned ball control and ball retention benefits. As long as the spaces between the protrusions are small enough in relation to the curve of the outside face of the ball such that the ball cannot pass between protrusions without contacting the protrusions, the individual protrusions are preferable to minimize the weight of the head. Moreover, when protrusions are applied to both the top and bottom edges of a sidewall, having staggered, alternating individual protrusions enables a lacrosse head frame to comply with dimensional rules governing the maximum height of a sidewall, as described above.

The foregoing disclosure of the preferred embodiments of the present invention has been presented for purposes of illustration and description. It is not intended to be exhaustive or to limit the invention to the precise forms disclosed. Many variations and modifications of the embodiments described herein will be apparent to one of ordinary skill in the art in light of the above disclosure. The scope of the invention is to be defined only by the claims, and by their equivalents.

What is claimed is:

1. A lacrosse head comprising:

a frame having a frame member, the frame member having a first edge, an inside surface, a second edge disposed on a side of the inside surface generally opposite to the first edge, the first edge and the second edge generally opposing each other along a measuring direction, a first protrusion disposed on the first edge, a second protrusion disposed on the first edge, the first protrusion and the second protrusion defining a space between each other, and a third protrusion disposed on the second edge generally opposite to the space, the first and second protrusions having a generally trapezoidal shape, with parallel sides of the trapezoidal shape comprising a short side and a long side, the long side disposed at the first edge, the third protrusion having a generally trapezoidal shape, with parallel sides of the trapezoidal shape of the third protrusion comprising a short side and a long side, the long side of the third protrusion disposed at the second edge.

2. The lacrosse head of claim 1, the first protrusion overlapping the third protrusion with respect to the measuring direction such that as the first protrusion decreases in height, the third protrusion increases in height.

3. The lacrosse head of claim 2, the first protrusion decreasing in height at substantially the same rate as the third protrusion increases in height.

4. The lacrosse head of claim 2, the sum of the heights of the first protrusion and the third protrusion, measured in the measuring direction, remaining substantially constant.

5. A lacrosse head comprising:

a frame having a frame member, the frame member having a first edge, an inside surface, a second edge disposed on a side of the inside surface generally opposite to the first edge, the first edge and the second edge generally opposing each other along a measuring direction, a first protrusion disposed on the first edge, a second protrusion disposed on the first edge, the first protrusion and the second protrusion defining a space between each other, and a third protrusion disposed on the second edge generally opposite to the space, the first, second, and third protrusions being disposed along a portion of the frame member such that heights of the frame member portion measured on a line parallel to the measuring direction, inclusive of any protrusions along the line, are substantially constant.

6. The lacrosse head of claim 5, the first and second protrusions having a generally polygonal shape and projecting from the surface of the first edge.

7. The lacrosse head of claim 5, the first, second, and third protrusions having a generally quadrilateral shape.

8. The lacrosse head of claim 5, the first and second protrusions having a generally trapezoidal shape, with parallel sides of the trapezoidal shape comprising a short side and a long side, the long side disposed at the first edge.

9. The lacrosse head of claim 5, the frame member comprising a sidewall of the lacrosse head.

10. The lacrosse head of claim 5, any height of the frame member measured on a line parallel to the measuring direction, inclusive of any protrusion along the line, not exceeding one of approximately 2 inches and approximately 1.8 inches.

11. The lacrosse head of claim 5, the third protrusion defining a thread opening.

12. The lacrosse head of claim 5, further comprising a handle attached to the frame.

13. The lacrosse head of claim 5, the frame adapted to receive a shaft along a shaft axis, the measuring direction being substantially perpendicular to the shaft axis.

14. The lacrosse head of claim 5, the frame enclosing an interior area, and the third protrusion protruding away from the interior area.

15. The lacrosse head of claim 14, the first and second protrusions protruding toward the interior area.

16. A lacrosse head having a ball receiving side and a pocket side, the lacrosse head comprising:

a sidewall having a ball receiving edge disposed on the ball receiving side of the lacrosse head and a pocket edge disposed on the pocket side of the lacrosse head, the ball receiving edge and the pocket edge generally opposite to each other along a measuring direction;

a first protrusion disposed on the ball receiving edge of the sidewall;

a second protrusion disposed on the ball receiving edge of the sidewall, the first protrusion and the second protrusion disposed along a portion of the sidewall;

a third protrusion disposed on the pocket edge of the sidewall, the third protrusion disposed substantially in between the first and second protrusions with respect to the measuring direction such that the height of the sidewall along the portion of the sidewall is substantially constant, the height measured on a line substantially parallel to the measuring direction and inclusive of any protrusions along the line.

17. The lacrosse head of claim 16, the third protrusion overlapping the first and second protrusion with respect to the measuring direction.

18. The lacrosse head of claim 17, the third protrusion and the first protrusion overlapping in a first overlap region, the third protrusion increasing in height as the first protrusion decreases in height in the first overlap region.

19. The lacrosse head of claim 18, the third protrusion and the second protrusion overlapping in a second overlap region, the third protrusion decreasing in height as the second protrusion increases in height in the second overlap region.

20. The lacrosse head of claim 16, the first protrusion spaced apart from the second protrusion.

21. A lacrosse head having a ball receiving side and a pocket side comprising:

a frame enclosing an interior area, the frame having a frame member, the frame member having a first edge on the ball receiving side of the lacrosse head, an inside surface facing the interior area, a second edge disposed on a side of the inside surface generally opposite to the first edge, the second edge on the pocket side of the lacrosse head, and a protrusion disposed on the second edge, the protrusion having an inner surface, and the protrusion protruding from the second edge in a direction away from the interior area such that the inner surface is at an angle to the inside surface of the frame member; and a pocket attached to the pocket side of the lacrosse head, the inner surface of the protrusion facing into the pocket.

22. The lacrosse head of claim 21, the frame member comprising a sidewall of the frame, and the protrusion comprising a single continuous protrusion along a majority of the sidewall.

23. The lacrosse head of claim 21, the protrusion comprising a first protrusion, and the frame member further having a second protrusion disposed on the second edge, the first protrusion and the second protrusion defining a space between each other, and a third protrusion disposed on the first edge generally opposite to the space, the first protrusion having an inner surface, and the third protrusion protruding from the first edge in a direction toward the interior area such that the inner surface of the third protrusion is at an angle to the inside surface of the frame member.

24. The lacrosse head of claim 23, the first edge and the second edge generally opposite to each other along a measuring direction, the first protrusion and the second protrusion disposed along a portion of the frame member, and the third protrusion disposed substantially in between the first and second protrusions with respect to the measuring direction such that the height of the frame member along the portion of the frame member is substantially constant, the height measured on a line substantially parallel to the measuring direction and inclusive of any protrusions along the line.

* * * * *